US006523514B1

(12) United States Patent
Motohashi

(10) Patent No.: US 6,523,514 B1
(45) Date of Patent: Feb. 25, 2003

(54) ROCKER ARM AND METHOD OF MANUFACTURING ROCKER ARM BODY

(75) Inventor: Nobutsuna Motohashi, Osaka (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 09/743,868

(22) PCT Filed: Aug. 14, 2000

(86) PCT No.: PCT/JP00/05456

§ 371 (c)(1),
(2), (4) Date: Jan. 16, 2001

(87) PCT Pub. No.: WO01/12957

PCT Pub. Date: Feb. 22, 2001

(30) Foreign Application Priority Data

Aug. 18, 1999 (JP) ..... 11-231463
Aug. 18, 1999 (JP) ..... 11-231464

(51) Int. Cl.[7] ..... F01L 1/18
(52) U.S. Cl. ..... 123/90.39; 29/888.2; 74/519; 123/90.41; 123/90.42
(58) Field of Search ..... 123/90.39, 90.41, 123/90.42, 90.43, 90.44, 90.45, 90.46; 29/888.2; 74/519, 559

(56) References Cited

U.S. PATENT DOCUMENTS

| | | | | | |
|---|---|---|---|---|---|
| 4,614,171 | A | * | 9/1986 | Malhotra | 123/90.44 |
| 4,628,874 | A | | 12/1986 | Barlow | |
| 4,825,717 | A | * | 5/1989 | Mills | 74/519 |
| 4,829,647 | A | * | 5/1989 | Anderson | 29/156.4 R |
| 5,325,825 | A | * | 7/1994 | Schmidt | 123/90.39 |
| 5,535,641 | A | | 7/1996 | Uchida et al. | |
| 5,642,693 | A | * | 7/1997 | Kotani | 123/90.41 |
| 5,678,305 | A | * | 10/1997 | Nagano | 29/888.2 |
| 5,720,245 | A | | 2/1998 | Calka | |
| 5,819,694 | A | | 10/1998 | Trutescu et al. | |
| 6,199,527 | B1 | * | 3/2001 | Okubo | 123/90.41 |

FOREIGN PATENT DOCUMENTS

| | | | | |
|---|---|---|---|---|
| DE | 19652676 | | 6/1998 | |
| DE | 19721210 | | 11/1998 | |
| GB | 2115898 | | 9/1983 | |
| JP | 3172506 | * | 7/1991 | F01L/1/18 |
| JP | 4259611 | | 9/1992 | |
| JP | 06017614 | | 1/1994 | |
| JP | 11-270311 | | 10/1999 | |
| JP | 11-270312 | | 10/1999 | |
| JP | 2000-120411 | | 4/2000 | |

* cited by examiner

*Primary Examiner*—Thomas Denion
*Assistant Examiner*—Jaime Corrigan
(74) *Attorney, Agent, or Firm*—Jordan and Hamburg LLP

(57) ABSTRACT

It is an object of the present invention to provide a rocker arm having such a shape as to avoid generation of defects in a producing process and to avoid increase in weight and design change of a finished shape. A valve fitting portion 11 of a body 5 is formed by wall-thickening one connecting wall 9 and recessing the connecting wall 9 upward. In the wall thickening, a periphery of the connecting wall 9 is pressurized and compressed from end face sides. As a result, defects such as cracking and sinking that occur in forcible guided-bending can be prevented and reduction of rigidity generated in compressing areas of the metal plate to be formed with side walls in wall thickness directions to reduce thickness of the areas as described in the description of the prior art can be avoided. Therefore, it is unnecessary to use a thick metal plate unlike in the prior art and to change design of the finished shape of the rocker arm body.

15 Claims, 9 Drawing Sheets

ROCKER ARM AND METHOD OF MANUFACTURING ROCKER ARM BODY

TECHNICAL FIELD

The present invention relates to a rocker arm tilted by a cam to open and close a valve provided to a cylinder head and a method of producing a body of the rocker arm.

BACKGROUND TECHNIQUE

As a prior-art rocker arm of this type, there is a rocker arm called an end pivot type that is tilted by a cam on one end side as a fulcrum to open and close a valve on the other end side.

The rocker arm includes a body and a roller mounted to the body for coming into contact with the cam to tilt the body.

The body is formed by bending one metal plate into a substantially U shape in section to have side walls in a pair and facing each other in a longitudinal direction and connecting walls for connecting the opposite side walls on longitudinal opposite ends.

A valve fitting portion into which an upper end of the valve is fitted is provided to one connecting wall and a pivot receiver into which an upper end of a pivot portion disposed in a cylinder head is fitted is provided to the other connecting wall.

A roller is rotatibly supported through a spindle between the side walls in the pair and facing each other in a state in which a portion of the roller projects from a through hole provided between the two connecting walls of the body.

The valve fitting portion is obtained by applying guided-bending processing to the body into a substantially U shape in section and then by applying guided-bending processing to cone connecting wall of the body into a substantially inverted M shape in an end face by pushing the one connecting wall up to midway positions in a vertical direction of the side walls in the pair.

This structure is shown in FIGS. 18 to 20. In these drawings, a reference numeral 50 designates the valve fitting portion, 51 and 52 the sidewalls in the pair, and 53 a connecting wall.

Because the above guided-bending processing is forcible guided-bending processing, defects such as cracking that reduces strength and sinking that reduces accuracy of a shape are likely to be generated in outer surfaces of bent portions between the side walls 51 and 52 in the pair and the connecting wall 53. Such defects are main causes of variations in a width W of the valve fitting portion 50 and a rate of generation of defective items increases.

Therefore, the present inventors have accomplished the present invention with the above circumstances in view. In the present invention, a wall thickness of the connecting wall 53 is increased by gathering wall portions of other areas such as the side walls 51 and 52 to the connecting wall 53 and a lower face of the thickened connecting wall 53 is recessed to form the valve fitting portion 50 recessed upward.

In the present invention, when the wall portions of the side walls 51 and 52 are caused to flow into the connecting wall 53, the wall thickness of the side walls 51 and 52 reduce and rigidity of the side walls 51 and 52 may reduce. In order to avoid reduction of rigidity of the side walls 51 and 52, it is necessary to take measures such as using a thick metal plate for the metal plate as a matrix of the body or changing design of a finished shape of the rocker arm body. Because weight increases in the former while cost of design change increases in the latter, there is room for improvement.

Furthermore, the valve fitting portion of the body may be desired to be disposed in a higher position than the pivot receiver depending on an object for which the rocker arm is used. In such a case, it is necessary to push the valve fitting portion further upward in the prior-art structure and the above defects are more likely to be generated. There is also room for improvement.

Therefore, it is an object of the present invention to provide a rocker arm having such a shape as to avoid generation of the above defects in a producing process and a method of producing a body of the rocker arm.

It is another object of the present invention to provide a rocker arm having such a shape as to avoid increase in weight and change in design in addition to the above shape for avoiding generation of the defects in the producing process and a method of producing a body of the rocker arm.

It is yet another object of the present invention to provide a rocker arm having such a shape as to easily adjust a height position of the valve fitting portion in addition to the above shape for avoiding generation of the defects in the producing process and a method of producing a body of the rocker arm.

DISCLOSURE OF THE INVENTION (1) According to the present invention, there is provided a rocker arm tilted by a cam to open and close a valve provided to a cylinder head, wherein the rocker arm comprises a body obtained by bending one metal plate into a substantially U shape in section to form side walls in a pair and facing each other and a connecting wall for connecting the opposite side walls and a roller mounted for rotation and for coming into contact with the cam between the opposite side walls of the body, a wall thickness of the connecting wall of the body is increased by flowing of a wall portion of a peripheral portion of the connecting wall, and recessing processing is applied to a lower face of the thickened connecting wall to form a valve fitting portion.

Because the valve fitting portion of the rocker arm of the present invention is formed by applying recessing processing to the lower face of the thickened connecting wall, there are not bent portions between the side walls and the connecting wall for forming the valve fitting portion unlike the prior art. Therefore, defects such as cracking that reduces strength and sinking that reduces accuracy of a shape like in prior art do not occur. As a result, it is possible to suppress variations in a width of the valve fitting portion and to reduce a rate of generation of defective items.

(2) According to the present invention, there is provided a rocker arm tilted by a cam to open and close a valve provided to a cylinder head, wherein the rocker arm comprises a body obtained by bending one metal plate into a substantially U shape in section to form side walls in a pair and facing each other and a connecting wall for connecting the opposite side walls and a roller mounted for rotation and for coming into contact with the cam between the opposite side walls of the body, a wall thickness of the connecting wall of the body is increased by flowing of a wall portion of a peripheral portion of the connecting wall by pressurizing and compressing the peripheral portion and recessing processing is applied to a lower face of the thickened connecting wall to form a valve fitting portion, the metal plate has areas to be formed with the side walls and an area to be formed with the connecting wall and has a overhanging chip at a periphery of the area to be formed with the connecting wall, and the overhanging chip is used as the peripheral portion.

In the present invention, similarly to the rocker arm in above (1), defects such as cracking that reduces strength and sinking that reduces accuracy of a shape like in prior art do not occur. As a result, it is possible to suppress variations in a width of the valve fitting portion and to reduce a rate of generation of defective items.

In the present invention, in addition to the above effects, it is unnecessary to increase the wall thickness of the whole metal plate unlike in the above by using the wall portions of the overhanging chips for thickening the connecting wall, thereby avoiding increase in weight of the rocker arm. Furthermore, because it is unnecessary to change design of the finished shape of the rocker arm body, increase in cost for design change can be avoided.

(3) According to the present invention, there is provided a rocker arm tilted by a cam to open and close a valve provided to a cylinder head, wherein the rocker arm comprises a body obtained by bending one metal plate into a substantially U shape to form side walls in a pair and facing each other and a connecting wall for connecting the opposite side walls and a roller mounted for rotation and for coming into contact with the cam between the opposite side walls of the body, an upper face of a longitudinal one end side area of the connecting wall is disposed in a higher position than an upper face of longitudinal the other end side area in a stepped manner, a wall thickness on a longitudinal one end side of the connecting wall is increased only toward a lower face side by gathering a wall portion from a peripheral portion of the connecting wall, and a valve fitting portion is formed to be recessed upward in the lower face of the connecting wall.

In the present invention, similarly to the rocker arm in above (1), defects such as cracking that reduces strength and sinking that reduces accuracy of a shape like in prior art do not occur. As a result, it is possible to suppress variations in a width of the valve fitting portion and to reduce a rate of generation of defective items.

In the present invention, in addition to the above effects, it is possible to obtain the body in which the valve fitting portion is disposed in the higher position than the pivot receiver by relatively easy processing in which the connecting wall is bent into a stepped shape in the producing process of the body when a height difference is required between the longitudinal opposite ends of the connecting wall of the body so as to conform to a relationship between an upper end position of the valve and an upper end position of a tilting fulcrum in an object for which the rocker arm is used.

THE BEST MODES FOR CARRYING OUT THE INVENTION

Figure 1:
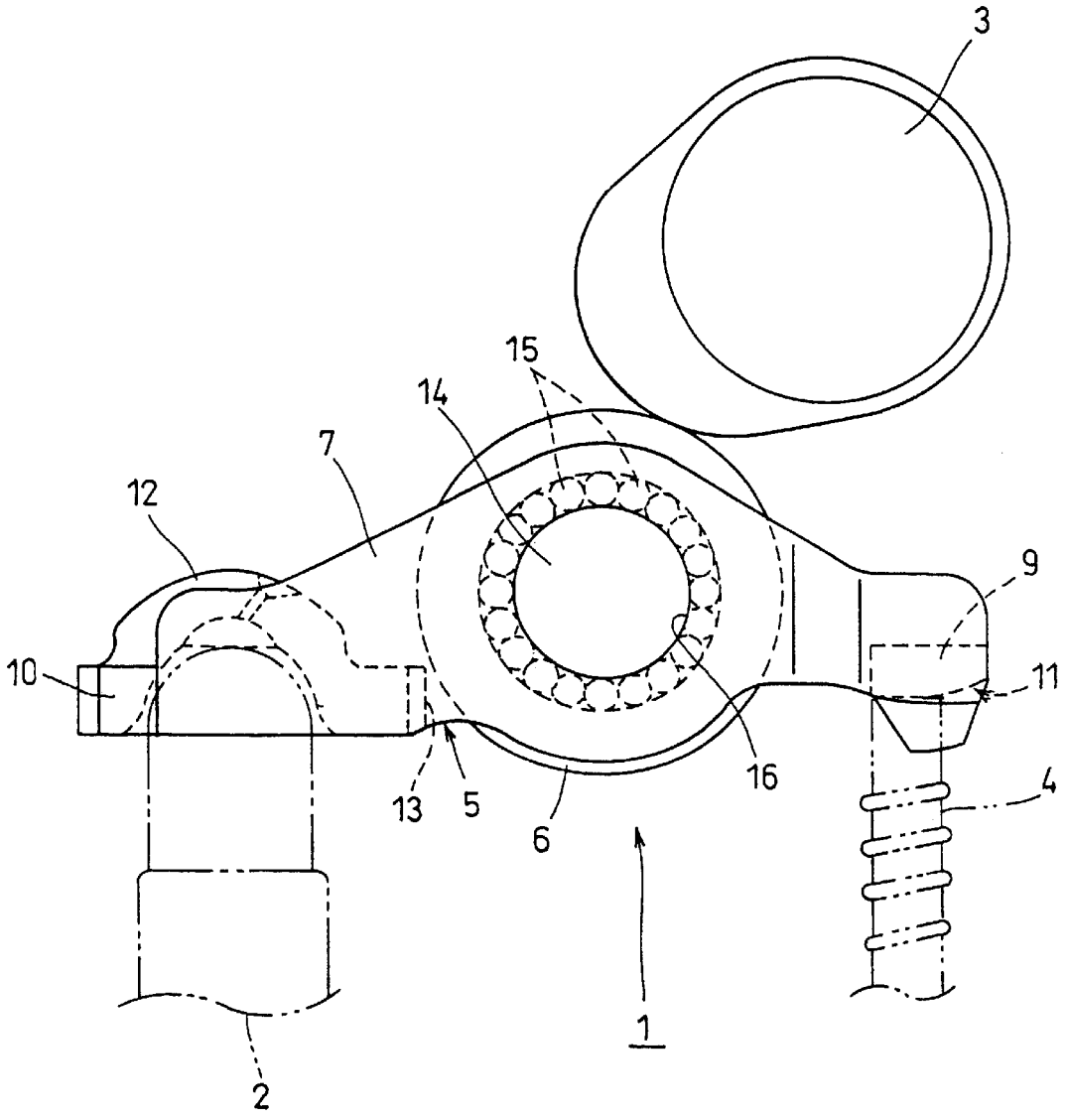
FIG. 1 is a side view of a rocker arm of an embodiment of the present invention.
Figure 2:
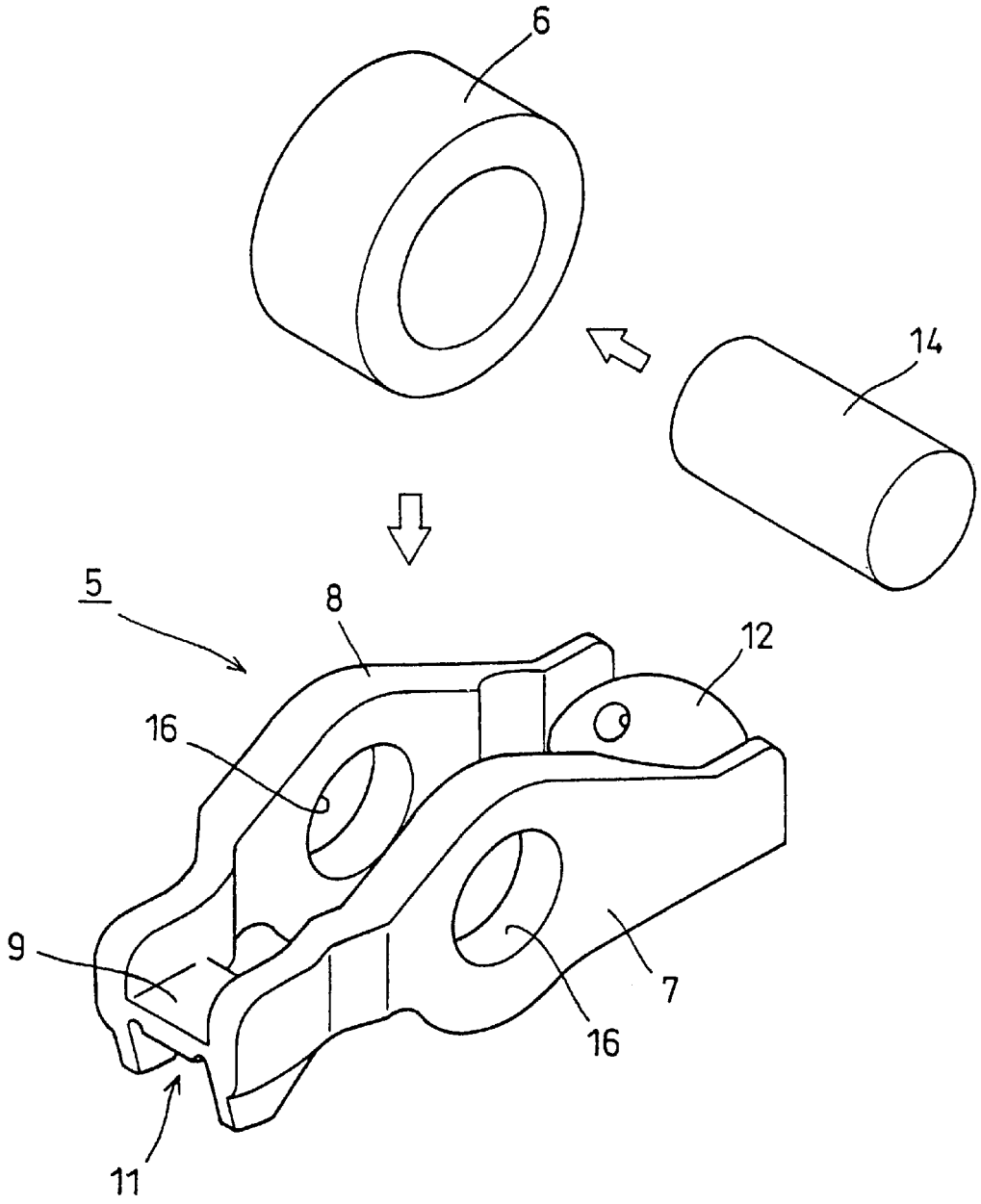
FIG. 2 is an exploded perspective view of the rocker arm of the embodiment.
Figure 3:
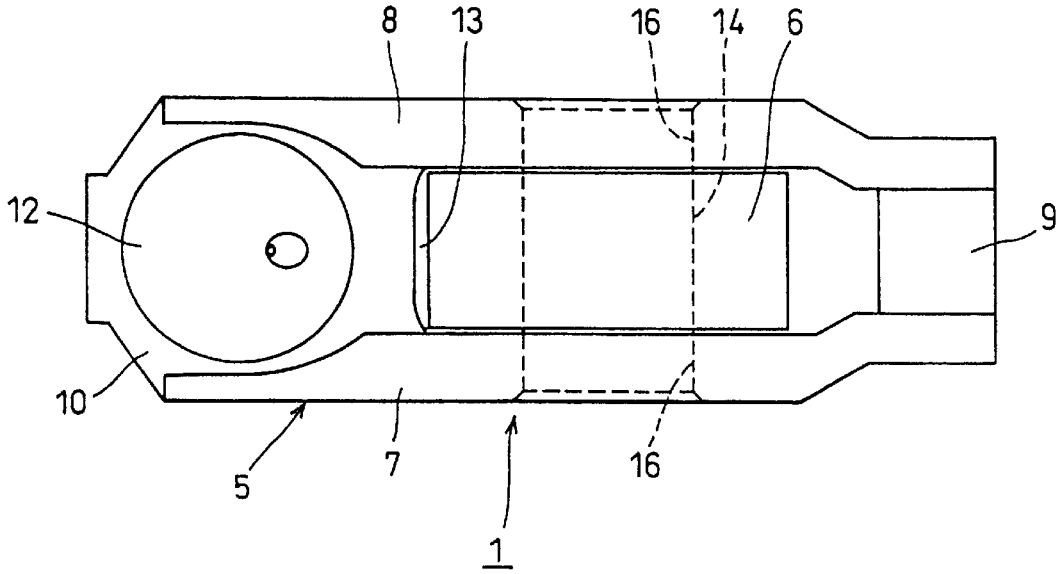
FIG. 3 is a plan view of the rocker arm.
Figure 4:
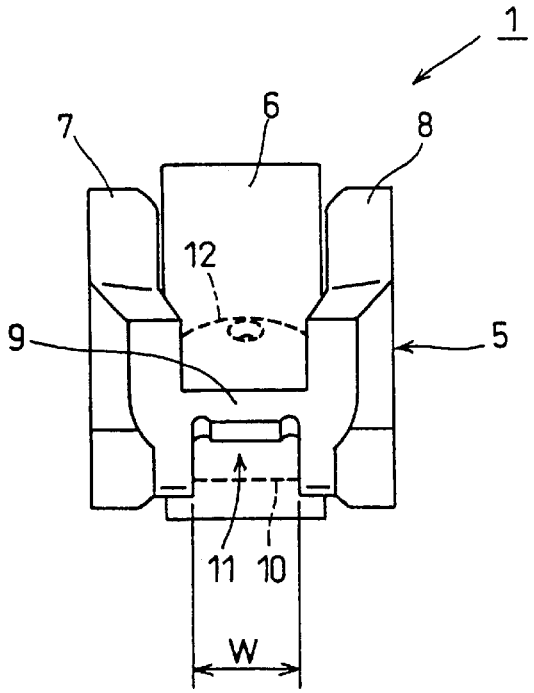
FIG. 4 is an end view of the rocker arm viewed from a side of a valve fitting portion.

The best embodiments of the present invention will be described below in detail by reference to FIGS. 1 to 9.

By reference to FIGS. 1 to 4, a reference numeral 1 designates a rocker arm called an end pivot type. The rocker arm 1 is supported on its longitudinal one end side by a lash adjuster 2. The rocker arm 1 is tilted on the longitudinal one end side as a fulcrum by a cam 3. A valve 4 on longitudinal the other end side of the rocker arm 1 is opened and closed by the tilting operation of the cam 3.

The rocker arm 1 includes two components, i.e., a body 5 and a roller 6.

The body 5 is formed by guided-bending one metal plate into a substantially U shape in section by presswork.

The body 5 includes side walls 7 and 8 in a pair and facing each other, a connecting wall 9 on a longitudinal one end side, and a connecting wall 10 on the longitudinal other end side. To the one connecting wall 9, a valve fitting portion 11 for receiving an upper end of the valve 4 and recessed upward is provided. To the other connecting wall 10, a pivot receiver 12 for receiving an upper end of the lash adjuster 2 and projecting into a hemispherical shape is provided. A through hole 13 is provided to side wall intermediate portions of the side walls 7 and 8 positioned between the connecting walls 9 and 10.

The roller 6 is rotatibly supported through a spindle 14 and a plurality of needle rollers 15 between the side walls 7 and 8 facing each other of the body 5 in a state in which a portion of the roller 6 is projecting from the through hole 13.

A method of producing the body 5 will be described by reference to FIGS. 5 to 9.

Figure 5:
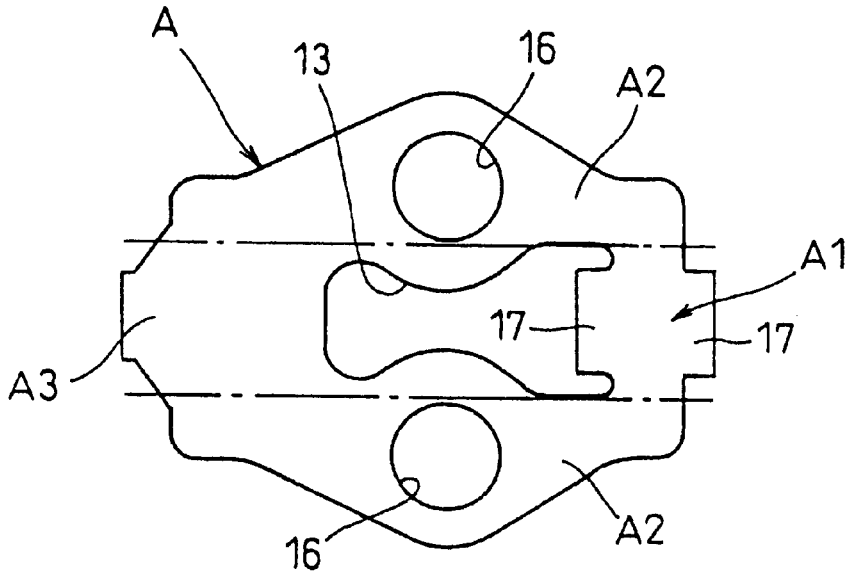
FIG. 5 is a plan view of a metal plate and for explanation of a step of die cutting processing in presswork applied to one metal plate in a procedure by which a rocker arm body shown in FIG. 1 is produced.

First, die-cutting processing by presswork is applied to one metal plate to obtain a metal plate A having an outside shape as shown in FIG. 5. At a longitudinal intermediate portion of the metal plate A, the through hole 13 is formed. Around the through hole 13 as a center, there are an area A1 on the longitudinal one end side that is to be formed with the one connecting wall 9, areas A2, A2 on opposite sides that are to be formed with the side walls 7 and 8, and an area A3 on the longitudinal other end side that is to be formed with the other connecting wall 10. Through holes 16, 16 through which the spindle passes are formed in the areas A2, A2.

On longitudinal opposite sides of the area A1, overhanging chips 17, 17 as peripheral portions of the area A1 are formed.

Figure 6:
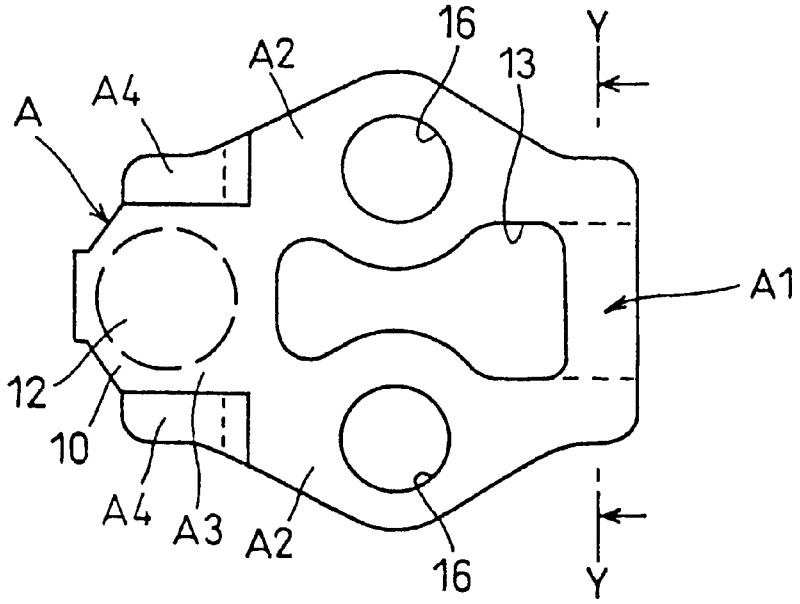
FIG. 6 is a plan view of the metal plate and for explanation of a step of wall thickening applied to an area to be formed with the valve fitting portion in the metal plate that has been subjected to die cutting processing in the above procedure.

The area A1 is to be formed with the valve fitting portion 11. In order to increase a wall thickness of the area A1, the overhanging chips 17, 17 are pressurized, compressed, and crushed toward the area A1 as shown in FIG. 6 by pinching end faces of the overhanging chips 17, 17 from longitudinal opposite sides.

Figure 7:
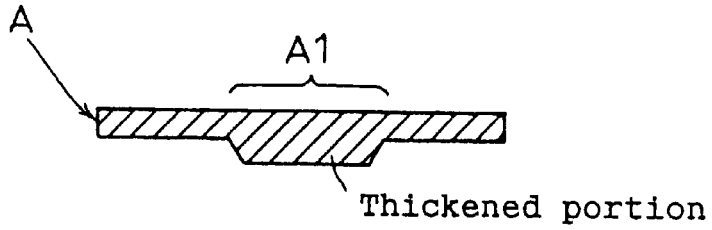
FIG. 7 is a view taken in a direction of arrows and along a line Y—Y in FIG. 6.

As a result, wall portions of the overhanging chips 17, 17 plastically flow toward the area A1. When the flowing wall portions are gathered in the area A1 as shown in FIG. 7, the wall thickness of the area A1 increases. By holding an upper face of the area A1 by a die (not shown) in the wall thickening processing, the thickness of the area A1 is increased such that only a lower face side of the area A1 bulges.

Then, by applying drawing processing by presswork to the area A3, the pivot receiver 12 projecting upward into the hemispherical shape is formed. The pivot receiver 12 may be formed after the step of forming the valve fitting portion 11 and the guided-bending step of the metal plate A.

Figure 8:
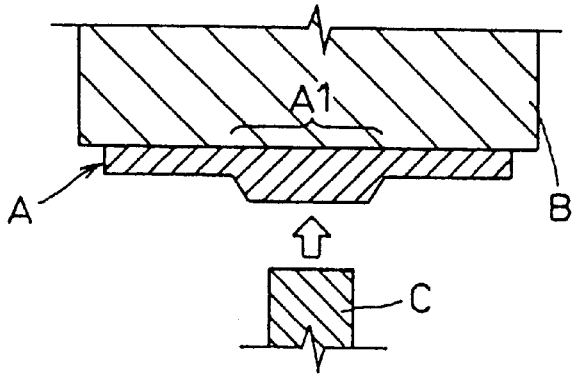
FIG. 8 is a sectional view for explanation of a step of half-stamping processing applied to a metal plate shown in section in FIG. 7 to form the valve fitting portion.

Then, by applying half-punching processing by presswork using an upper die B and a lower die C to the area A1 as shown in FIG. 8, the valve fitting portion 11 recessed upward is formed in the area A1. In this case, a ceiling face of the valve fitting portion 11 is curved into a semicircular shape and this shape is formed by copying a shape of an end face of the lower die C.

Figure 9:
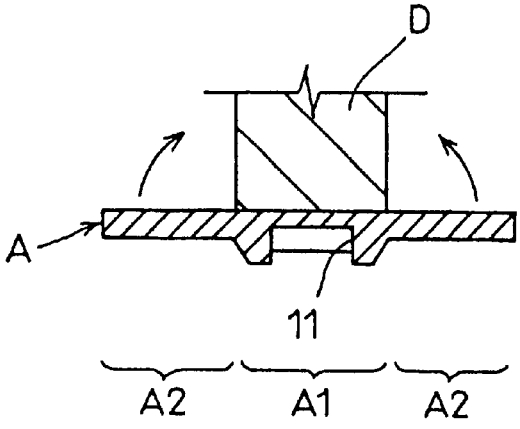
FIG. 9 is a sectional view for explanation of a step of guided-bending of the metal plate shown in section in FIG. 8 into a U shape to obtain a pair of side walls and connecting walls.

The areas A2, A2 which are on opposite sides of the area A1 of the metal plate A formed as described above are bent into a substantially U shape along one-dot dashed lines in FIG. 5 by carrying out guided-bending processing in directions of arrows by presswork by using a die D as shown in FIG. 9.

As a result, the body 5 having the pair of side walls 7 and 8 and the connecting walls 9 and 10 can be obtained.

Opposite sides of the pivot receiver 12 in the areas A2, A2 which will be the side walls 7 and 8 of the metal plate A are compressed in wall thickness directions to be thin-walled portions A4.

The through hole 16 may be formed after the guided-bending processing of the opposite side walls 7 and 8. The pivot receiver 12 may be formed after the guided-bending processing of the opposite side walls 7 and 8.

Because the valve fitting portion 11 described above can be obtained by the half-punching processing in which the wall thickness of the one connecting wall 9 is increased and recessed upward, defects such as cracking or sinking from which the prior art suffer do not generate. Therefore, variations in strength and accuracy of the shape caused by the defects can be eliminated.

Because an inner face of the valve fitting portion 11 is obtained by shearing in the half-punching processing, it is possible to more accurately control a width W of the valve fitting portion 11 and to stabilize operability and improve stability of operation of the valve 4 by the valve fitting portion 11.

Because the overhanging chips 17, 17 are crushed to increase the wall thickness of the one connecting wall 9, it is possible to avoid reduction of rigidity of the connecting wall 9. Therefore, it is unnecessary to use a metal plate A with a large wall thickness. Because an amount of increase in the wall thickness can be increased or reduced by adjusting sizes of the overhanging chips 17, 17, a degree of freedom in design can be increased.

Because only one face side of the one connecting wall 9 is caused to bulge in the wall thickening, it is possible to specify a recessing amount of the valve fitting portion 11 with respect to a face of the connecting wall 9 on an opposite side. As a result, positioning of the ceiling face of the valve fitting portion 11 is facilitated.

The present invention is not limited to the above-described best embodiment and applications and modifications described below can be made.

Another embodiment of the present invention will be described by reference to FIGS. 10 to 17.

Figure 10:
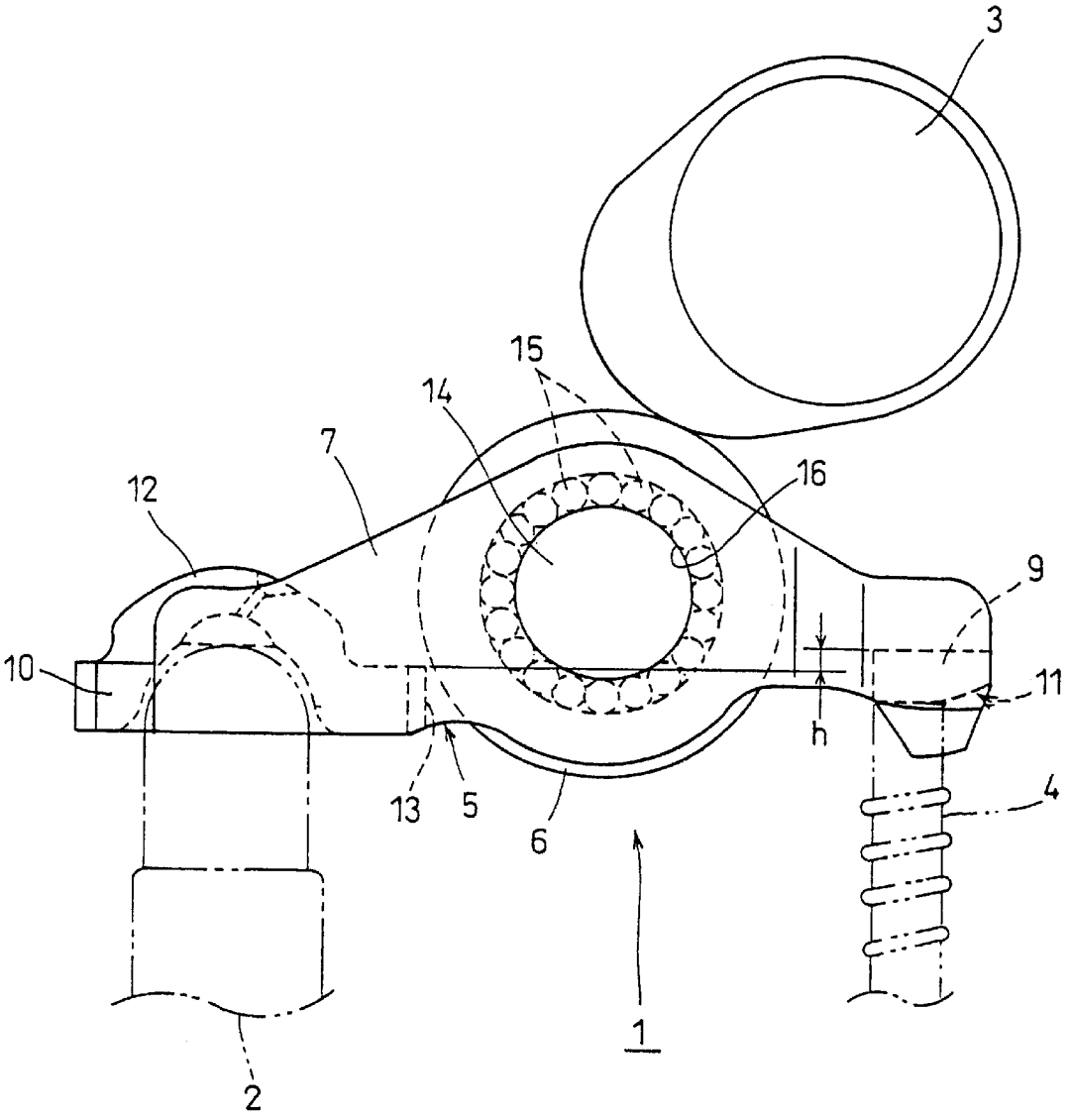
FIG. 10 is a side view of a rocker arm according to another embodiment of the present invention.

In FIG. 10, a reference numeral 1 designates a rocker arm, 2 a lash adjuster, 3 a cam, 4 a valve, 5 a body, 6 a roller, 7 and 8 side walls, 9 and 10 connecting walls, 11 a valve fitting portion, 12 a pivot receiver, 13 a through hole, 14 a spindle, and 15 needle rollers.

An upper face of the one connecting wall 9 provided with the valve fitting portion 11 is higher than an upper face of the other connecting wall 10 provided with the pivot receiver 12 by a necessary amount h.

A method of producing the body 5 shown in FIG. 10 will be described by reference to FIGS. 11 to 17.

Figure 11:
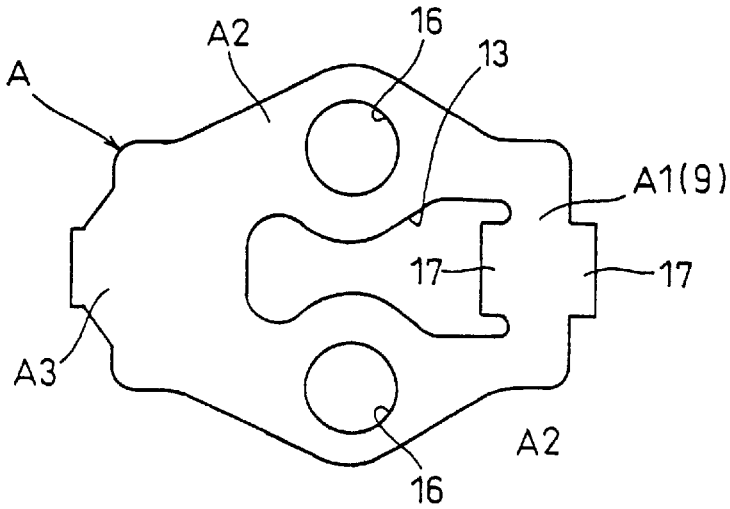
FIG. 11 is a plan view of a metal plate and for explanation of a step of die cutting processing by presswork applied to one metal plate in a procedure by which a rocker arm body shown in FIG. 10 is produced.

First, die-cutting processing is applied by presswork to one metal plate to obtain a metal plate A having an outside shape as shown in FIG. 11. In this processing, the through hole 13, insertion holes 16, 16, and overhanging chips 17, 17 are formed on the metal plate A.

Figure 12:
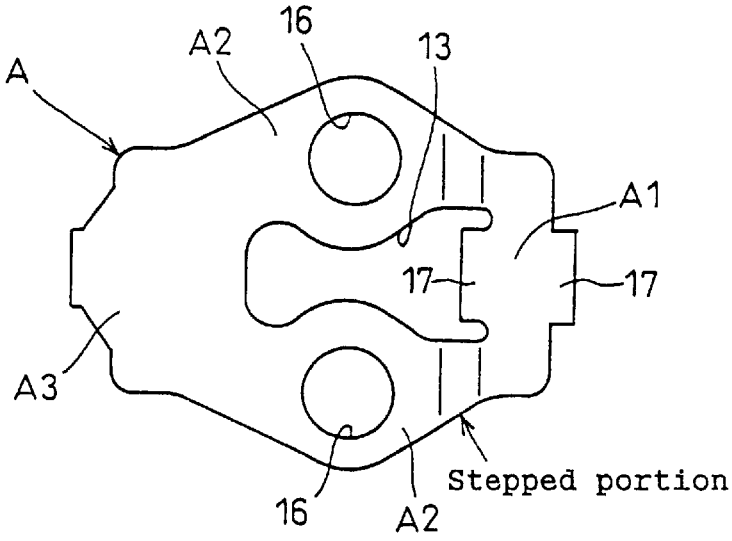
FIG. 12 is a plan view of the metal plate and for explanation of a step of bending of the metal plate shown in FIG. 11 into a stepped shape.
Figure 13:
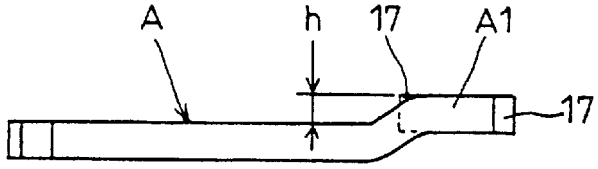
FIG. 13 is a side view of FIG. 12.

As shown in FIGS. 12 and 13, an area A1 to be formed with the valve fitting portion 11 is bent into a stepped shape that is stepped upward by a height difference h from other areas. The height difference is determined based on a deviation of an upper end position of the valve 4 and an upper end position of the lash adjuster 2 from each other and generated according to an object for which the rocker arm is used.

Figure 14:
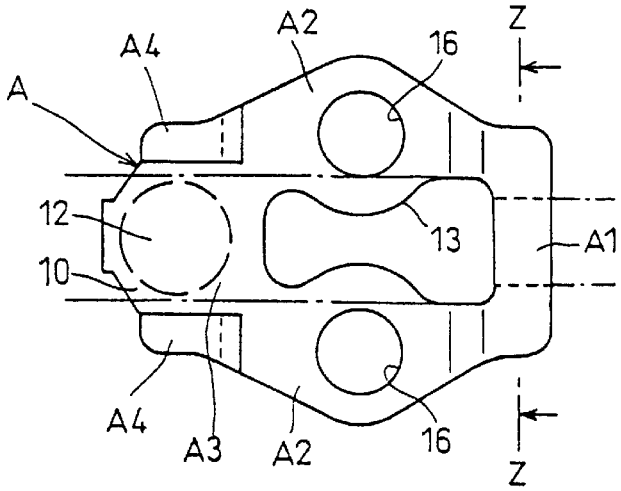
FIG. 14 is a plan view of the metal plate and for explanation of a step of pressurizing and compressing of the metal plate that has been subjected to processing in FIGS. 11 to 13.
Figure 15:
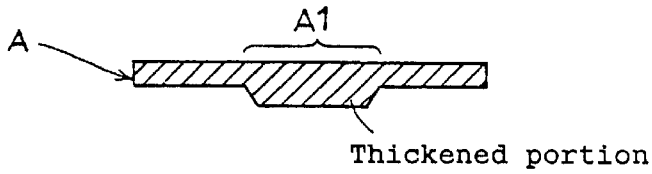
FIG. 15 is a view taken in a direction of arrows and along a line Z—Z in FIG. 14.
Figure 16:
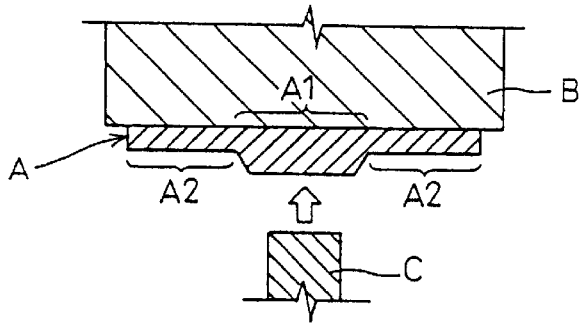
FIG. 16 is a sectional view for explanation of a step of half-punching processing applied to the metal plate shown in section in FIG. 15 for forming the valve fitting portion.
Figure 17:
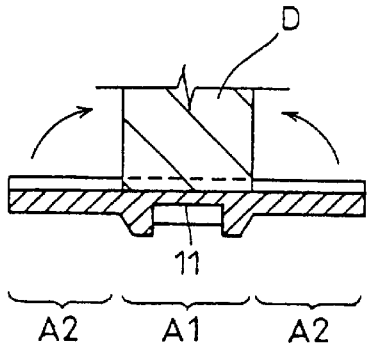
FIG. 17 is a sectional view for explanation of a step of guided-bending of the metal plate shown in section in FIG. 16 into a U shape to obtain a pair of side walls and connecting walls.
Figure 18:
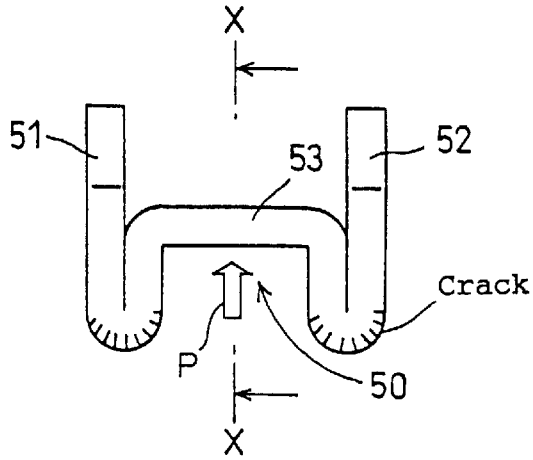
FIG. 18 is a cross sectional view of the rocker arm and for explanation to point out problems in prior art.
Figure 19:
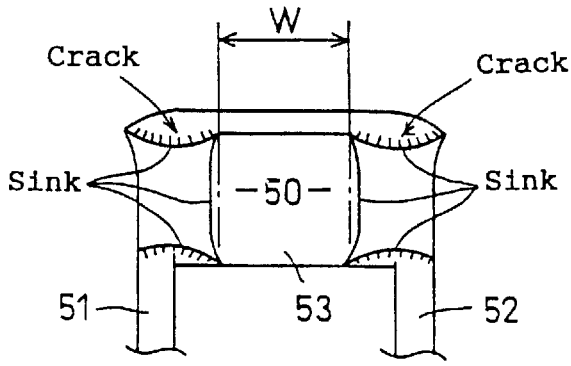
FIG. 19 is a bottom view of the rocker arm taken in a direction of an arrow P in FIG. 18.
Figure 20:
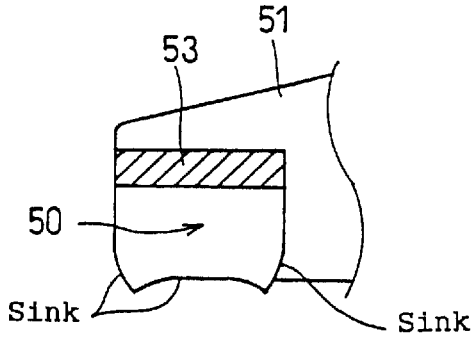
FIG. 20 is a sectional view taken along a line X—X in FIG. 18.

Then, the overhanging chips 17, 17 are pressurized, compressed, and crushed similarly to the above-described case and as shown in FIG. 14 to increase a wall thickness of the area A1 where the valve fitting portion 11 is to be formed. As a result, wall portions of the overhanging chips 17, 17 plastically flow. Because FIGS. 15 to 17 showing the succeeding processing are similar to FIGS. 7 to 9, description of the processing will be omitted.

As described above, if heights of the connecting walls 9 and 10 of the body 5 are different from each other because of a relationship between the upper end position of the valve 4 and the upper end position of the lash adjuster 2, the body 5 in which the valve fitting portion 11 is formed in the higher position than the pivot receiver 12 can be obtained by simple processing of bending the connecting walls 9 and 10 into the stepped shape.

Although the overhanging chips 17, 17 are formed only at two sides facing each other of the area A1 which will be the connecting wall 9 to increase the wall thickness of the connecting wall 9 in the above embodiment, it is also possible to form overhanging chips also in the areas A2, A2 positioned on opposite sides of the area A1 and to pressurize and compress the respective overhanging chips from four directions to increase the wall thickness of the area A1.

Although the roller 6 is supported on the spindle 13 through the plurality of needle rollers 14 in the above embodiments, the roller 6 may be rotatibly supported by sliding contact without using the needle rollers 14. In other words, the roller 6 may be directly fitted over the spindle 13 by clearance fit or may be fitted with the spindle 13 through a slide bearing such as a bushing.

Although the overhanging chips 17, 17 are crushed to increase the wall thickness of the connecting wall 9 in the above embodiment, it is also possible to pressurize and compress the areas A2, A2 in the wall thickness direction and to cause the areas A2, A2 to plastically flow into the area A1 to increase the wall thickness of the area A1 without forming the overhanging chips 17, 17.

Although the rocker arm 1 of the end pivot type is shown as an example in the above embodiment, the present invention can be applied also to a rocker arm of a center pivot type (not shown).

Possibility of Industrial Application

The present invention can be used satisfactorily as a rocker arm tilted by a cam to open and close a valve provided to a cylinder head.

What is claimed is:

1. The rocket arm tilted by a cam to open and close a valve provided to a cylinder head, comprising:

a body obtained by bending one metal plate into a substantially U-shaped cross section to form side walls in a pair and facing each other and a connecting wall for connecting said side walls;

a roller rotatably mounted between said side walls of said body for engaging a cam;

a thickened connecting wall portion of said connecting wall of said body formed by flowing of a peripheral portion of said connecting wall into said thickened connecting wall portion, wherein only one face side of said connecting wall is caused to bulge by said flowing of said peripheral portion; and a valve fitting portion formed using recessing processing applied to a lower face of said thickened connecting wall.

2. The rocker arm according to claim 1, wherein flowing of said peripheral portion into said thickened connecting wall portion is achieved by pressurizing and compressing said peripheral portion.

3. The rocker arm according to claim 1, wherein said recessing processing is half-punching processing by presswork.

4. The rocker arm of claim 1, wherein said thickened connecting wall portion is formed to be thicker than said side walls and said side walls and said connecting wall portion are of equal thickness prior to said flowing of said peripheral portion.

5. A rocker arm tilted by a cam to open and close a valve provided to a cylinder head, comprising:

a body obtained by applying guided-bending processing to one metal plate into a substantially U-shaped cross section to form side walls in a pair and facing each other and connecting walls for respectively connecting longitudinal opposite end sides of said side walls;

a roller rotatably mounted between said side walls of said body for engaging a cam;

a lower face of one of said connecting walls of said body being recessed to form a valve fitting portion for receiving an upper end of said valve and a lower face of the other connecting wall being formed into a pivot receiver for receiving an upper end of a lash adjuster; and said valve fitting portion is formed by wall-thickening said one connecting wall by pressurizing and compressing a peripheral portion of said one connecting wall into a thickened wall portion such that said one connecting wall bulges only from a lower face thereof when thcikened and by applying recessing processing to the lower face of said thickened wall portion.

6. A rocker arm tilted by a cam to open and close a valve provided to a cylinder head, comprising:

a body obtained by bending one metal plate into a substantially U-shaped cross section to form side walls in a pair and facing each other and a connecting wall for connecting said side walls;

a roller rotatably mounted between said side walls of said body for engaging a cam;

a thickened connecting wall portion of said connecting wall of said body formed by flowing of a peripheral portion of said connecting wall into said thickened connecting wall portion such that only a lower face of said thickened connecting wall portion bulges outward during the flowing; and said metal plate having areas to be formed into said side walls and an area to be formed into said connecting wall and has a overhanging chip at a periphery of said area to be formed said connecting wall, and wherein said overhanging chip is used as said peripheral portion.

7. A rocker arm tilted by a cam to open and close a valve provided to a cylinder head, comprising:

a body obtained by bending one metal plate into a substantially U-shaped cross section to form side walls in a pair and facing each other and a connecting wall for connecting said side walls;

a roller rotatably mounted between said side walls of said body for engaging a cam;

an upper face of a first longitudinal end of said connecting wall defining a first plane that is disposed closer to a rotation axis of said roller than a second plane defined by an upper face of a second longitudinal end side area in a stepped manner; and said first longitudinal end having a wall thickness increased only by a lower face bulged outward by wall thickening performed by gathering a wall portion from a peripheral portion of said connecting wall to flow into said first longitudinal end, and a valve fitting portion formed recessed upward in said lower face of said connecting wall.

8. A rocker arm tilted by a cam to open and close a valve provided to a cylinder head, comprising:

a body obtained by applying guided-bending processing to one metal plate to form a substantially U-shaped cross section having side walls in a pair and facing each other and first and second connecting walls for respectively connecting first and second longitudinal ends of said side walls;

a roller rotatably mounted between said side walls of said body for engaging a cam;

a lower face of said first connecting wall is recessed to form a valve fitting portion for receiving an upper end of said valve and a lower face of the second connecting wall is formed with a pivot receiver for receiving an upper end of a lash adjuster, an face of said first connecting wall defining a first plane disposed closer to an axis of rotation of said roller than a second plane defined by an upper face of said second connecting wall such that said valve fitting portion is disposed in a higher position than said pivot receiver; and said valve fitting portion formed by wall-thickening said first connecting wall by pressurizing a peripheral portion of said first connecting wall and by applying recessing processing to a lower face of said first connecting wall after wall-thickening.

9. A method of producing a body of a rocker arm formed of one metal plate shaped into a substantially U-shaped cross section to form side walls in a pair and facing each other and a connecting wall for connecting said side walls and having at a lower face of said connecting wall a valve fitting portion, comprising the steps of:

punching said one metal plate into a shape having an area to be formed into said valve fitting portion with adjoining side wall areas, increasing a wall thickness of said area by pressurizing a portion limited to a periphery portion of said area from an end face in said metal plate, after said punching, to plastically flow material from said periphery portion into a main portion of said area thereby thickening said main portion, recessing by presswork one face of said main portion to obtain said valve fitting portion recessed upward, and bending said metal plate such that said side wall areas stand in the same direction as a recessed direction of said valve fitting portion to form said side walls.

10. The method of producing a body of a rocker arm according to claim 9, wherein said metal plate is thickened in said wall thickening such that one face side of said metal plate bulge.

11. A method of producing a body of a rocker arm including said body obtained by bending one metal plate into a substantially U shape in section to form side walls in a pair and facing each other and a connecting wall for connecting said opposite side walls and having at a lower face of said connecting wall a valve fitting portion, wherein said method comprises the steps of punching said one metal plate into a necessary shape having an area to be formed with said valve fitting portion, wall thickening for increasing a wall thickness of said area by pressurizing, compressing, and crushing a periphery of said area from an end face in said metal plate punched in said punching to gather a plastically flowing wall portion into said area, recessing by presswork one face of said area thickened in said wall thickening to obtain said valve fitting portion recessed upward, and bending said metal plate such that opposite side portions of said area formed with said valve fitting portion in said metal plate stand in the same direction as a recessed direction of said valve-fitting portion to obtain a pair of side walls, wherein said metal plate is punched in said punching into a shape having overhanging chips that are to be crushed for wall thickening of said area to be formed with said valve fitting portion at two sides facing each other of said area, and said opposite overhanging chips are pressurized, compressed, and crushed from end faces of said overhanging chips in said wall thickening to cause wall portions of said overhanging chips to plastically flow toward said area.

12. A method of producing a body of a rocker arm including said body obtained by bending one metal plate into a substantially U shape in section to form side walls in a pair and facing each other and a connecting wall for connecting said opposite side walls and having at a lower face of said connecting wall a valve fitting portion, wherein said method comprises the steps of punching said one metal plate into a necessary shape having an area to be formed with said valve fitting portion, bending said one metal plate punched into said necessary shape in said punching such that said area is stepped toward one side in a wall thickness direction, wall thickening for increasing a wall thickness of said area by pressurizing and compressing a periphery of said area to be formed with said valve fitting portion to gather a plastically flowing wall portion from said periphery to the other side in said wall thickness direction of said area, recessing by presswork said thickened portion of said area to obtain said valve fitting portion recessed upward, and bending said metal plate such that opposite side portions of said area formed with said valve fitting portion stand in the same direction as a recessed direction of said valve fitting portion to obtain a pair of side walls.

13. A method of producing a body of a rocker arm formed of one metal plate shaped into a substantially U-shaped cross section to form side walls in a pair and facing each other and a connecting wall for connecting said side walls and having at a lower face of said connecting wall a valve fitting portion, comprising the steps of:

punching said one metal plate into a shape having an area to be formed into said valve fitting portion with adjoining side wall areas, increasing a wall thickness of said area by pressurizing a portion limited to a periphery portion of said area from an end face in said metal plate, after said punching, to plastically flow material from said periphery portion into a main portion of said area thereby thickening said main portion, recessing by presswork one face of said main portion to obtain said valve fitting portion recessed upward, and bending said metal plate such that said side wall areas stand in the same direction as a recessed direction of said valve fitting portion to form said side walls, wherein said metal plate is punched in into a shape having overhanging chips extending from opposing sides of said main portion that serve as said periphery portion that is pressurized to flow into said main portion to thicken said main portion.

14. The method of producing a body of a rocker arm according to claim 13, wherein said main portion is thickened such that only one face side of said main portion bulges outward.

15. A method of producing a body of a rocker arm formed of one metal plate shaped into a substantially U-shaped cross section to form side walls in a pair and facing each other and a connecting wall for connecting said side walls and having at a lower face of said connecting wall a valve fitting portion, comprising the steps of:

punching said one metal plate into a shape having an area to be formed into said valve fitting portion with adjoining side wall areas, bending said one metal plate, after said punching, to offset said area in stepped manner a wall thickness direction from an remaining area, increasing a wall thickness of said area by pressurizing a portion limited to a periphery portion of said area from an end face in said metal plate, after said punching, to plastically flow material from said periphery portion into a main portion of said area thereby thickening said main portion, recessing by presswork one face of said main portion to obtain said valve fitting portion recessed upward, and bending said metal plate such that said side wall areas stand in the same direction as a recessed direction of said valve fitting portion to form said side walls.

* * * * *